US008556269B2

(12) United States Patent
Berger et al.

(10) Patent No.: US 8,556,269 B2
(45) Date of Patent: Oct. 15, 2013

(54) TRAVELING TARGET

(75) Inventors: Spencer B. Berger, Rexburg, ID (US); Tyler T. Beck, Aberdeen, ID (US)

(73) Assignee: B & B Steel Targets, LLC, Rexburg, ID (US)

( * ) Notice: Subject to any disclaimer, the term of this patent is extended or adjusted under 35 U.S.C. 154(b) by 330 days.

(21) Appl. No.: 12/984,057

(22) Filed: Jan. 4, 2011

(65) Prior Publication Data

US 2011/0163504 A1 Jul. 7, 2011

Related U.S. Application Data

(60) Provisional application No. 61/335,175, filed on Jan. 4, 2010.

(51) Int. Cl.
*F41J 7/00* (2006.01)

(52) U.S. Cl.
USPC ..... 273/392; 273/406

(58) Field of Classification Search
USPC ..... 273/386–392, 403–410
See application file for complete search history.

(56) References Cited

U.S. PATENT DOCUMENTS 1,424,632 A * 8/1922 Fenton ..... 273/392
1,537,738 A * 5/1925 Bisbing ..... 273/390
3,635,476 A * 1/1972 Breslow et al. ..... 273/390
4,093,227 A * 6/1978 Saunders et al. ..... 273/388
7,134,977 B2 * 11/2006 Campbell et al. ..... 473/454
7,712,743 B1 * 5/2010 Miller ..... 273/407
2011/0062668 A1 * 3/2011 Leimberer ..... 273/407
2012/0025468 A1 * 2/2012 Kreiman et al. ..... 273/386

OTHER PUBLICATIONS

Cosman, Matt, Czech Hedgehog Target, http://mk1tactical.com/MK1_Tactical/Rifle_Targets.html, 1 page, printed Jan. 7, 2011.

Cosman, Matt, Czech Hedgehog Steel Target Video, http://www.youtube.com/watch?v=alczE1C_1OM&feature=player_embedded, video published Apr. 28, 2010, 1 page, printed Jan. 7, 2011.

* cited by examiner

*Primary Examiner* — Mark Graham
(74) *Attorney, Agent, or Firm* — Pate Peterson, PLLC; Warren M. Pate

(57) ABSTRACT

A reactive target for firearms is disclosed. The target may include a center, four legs, and four heads. Each of the four legs may comprise an exterior end and radially extending from proximate the center to the exterior end. Each of the four heads may connect to the exterior end of a different leg of the four legs. Each of the four heads may also provide at least one target surface withstanding, without degradation, multiple impacts from firearm-fired projectiles. When an appropriate head is hit by a projectile, the target may roll a discrete, incremental distance on a supporting surface.

20 Claims, 5 Drawing Sheets

TRAVELING TARGET

RELATED APPLICATIONS

This application claims the benefit of U.S. Provisional Patent Application Ser. No. 61/335,175 filed Jan. 4, 2010, which application is hereby incorporated by reference.

BACKGROUND

1. The Field of the Invention

This invention relates to practice targets and, more particularly, to novel systems and methods for reactive targets that retreat in response to being hit.

2. The Background Art

Current reusable targets are typically designed to be anchored to the ground. While various components of the targets may move, the target surfaces (i.e., the surfaces upon which projectiles impact) typically return after each hit or within multiple hits to the same location. With each hit, the distance between the user and the target remains constant. Thus, the difficulty does not change between hits. Accordingly, what is needed is a traveling target that incrementally increases the difficultly of obtaining each successive hit.

BRIEF SUMMARY OF THE INVENTION

In view of the foregoing, in accordance with the invention as embodied and broadly described herein, a method and apparatus are disclosed in one embodiment of the present invention as including a traveling target. Such a target may include a body and multiple heads. The body may include an interior and multiple legs extending outward from the interior. For example, the body may include multiple legs extending radially away from a center point. Each leg may support a different head some distance from the interior.

A head may include one or more target surfaces. The target surfaces may provide a location for a projectile to impact a target. In use, a target may be positioned on a supporting surface. A user may identify a particular head at which to aim. In general, the particular head may be a head occupying a post of prominence (e.g., comprise the most elevated head on the target). A user may then project a projectile at the particular head. If the user is successful in hitting the particular head, the target may roll away from a user.

The roll of a target in accordance with the present invention may comprise a transition of the target from one stationary position of relatively high stability to another stationary position of relatively high stability. The impact of a projectile on the particular head may provide the energy necessary to transition out of the one position and into the other. During such a roll, the target may remove the particular head from the post of prominence and hoist a different head thereto. A hit to the different head may result in another discrete roll of the target.

A series of hits on appropriate heads (e.g., heads occupying the post) may result in a series of discrete rolls, moving the target away from the user. This movement of a target may force a user to repeatedly adjust his or her point of aim. Additionally, by moving a target generally away from a user, each hit may increase the difficult of achieving the next hit. Thus, a target in accordance with the present invention may comprise a traveling target providing incremental increases in difficulty.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF SELECTED EMBODIMENTS

Figure 1:
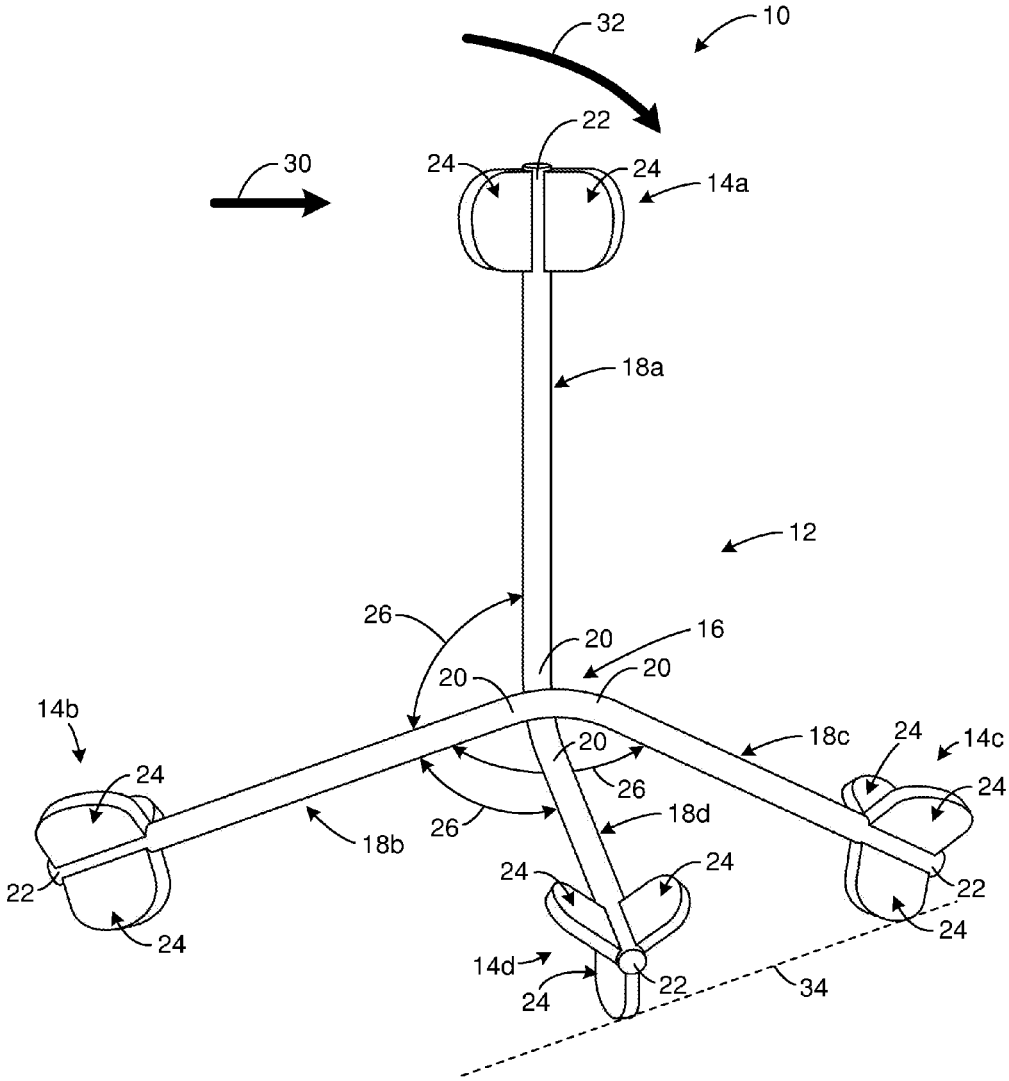
FIG. 1 is a perspective view of one embodiment of a target in accordance with the present invention.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Referring to FIG. 1, a target 10 in accordance with the present invention may include a body 12 and multiple heads 14. A body 12 may include an interior 16 and multiple legs 18 proceeding or extending outward from the interior 16. In selected embodiments, the interior 16 may comprise or be a center point. In such embodiments, multiple legs 18 may extending radially away from the center point.

The legs 18 of a target 10 may each include an interior end 20 proximate the interior 16 and an exterior end 22, opposite the interior end 20. In certain embodiments, the exterior ends 22 of the various legs 18 may each support a different head 14. In such embodiments, legs 18 may position the heads 14 with respect to the interior 16. For example, the legs 18 may space the heads 14 away from the interior 16. Accordingly, the number of heads 14 may correspond to or match the number of legs 18.

A head 14 in accordance with the present invention may include one or more target surfaces 24. The target surfaces 24 may provide a location for a projectile to impact a target 10. In use, a target 10 may be positioned on a supporting surface (e.g, the ground). A user may identify a particular head 14 at which to aim. In selected embodiments, the particular head 14 may be a head 14*a* occupying a position or post of prominence. For example, the particular head 14 may be a head 14*a* occupying a post of most elevated head 14 on the target 10 at the time of aiming.

Once a particular head 14 has been identified, a user may project a projectile at it. For example, the user may fire a bullet at the head 14*a*. If the user is successful in hitting the particular head 14, he or she may receive audible confirmation thereof. That is, the particular head 14 may produce a sound as a result of being hit. Additionally, the particular head 14 may move in response to the impact of the projectile. For example, a target 10 may move or travel on the supporting surface in response to the impact.

In selected embodiments and situations, a target 10 may roll away from a user in response to a hit on the particular head 14. The roll may comprise a discrete increment of movement. For example, a roll may comprise a transition of a target 10 from one stationary position of relatively high stability to another stationary position of relatively high stability. The impact of a projectile may provide the energy necessary to transition out of the one position and into the other. During such a roll, the target 10 may remove the particular head 14 from the post and hoist a different head 14 thereto. A hit to the different head 14 may result in another discrete roll of the target 10.

A series of hits on appropriate heads 14 may result in a series of discrete rolls, moving the target 10 away from the user. This movement of a target 10 may force a user to repeatedly adjust his or her point of aim. Additionally, by moving a target 10 away from a user, each hit may increase the difficult of achieving the next hit. Thus, a target 10 may comprise a traveling target 10 providing incremental increases in difficulty.

The legs 18 and corresponding heads 14 of a target 10 in accordance with the present invention may be substantially uniformly distributed about the interior 16. In certain embodiments, a target 10 may comprise four legs 18*a*, 18*b*, 18*c*, 18*d* extending radially away from an interior 16 formed as a center point. Accordingly, in such embodiments, a uniform distribution may make each leg 18 substantially equally angularly spaced from the other three legs 18. That is, each leg 18 (e.g., leg 18*b*) may be spaced from the other legs 18 (e.g., legs 18*a*, 18*c*, 18*d*) by an angle 26 of about 110 degrees.

In four-legged embodiments, each leg 18*b*, 18*c*, 18*d* may support a respective head 14*a*, 14*b*, 14*c*, 14*d*. Accordingly, when resting on a substantially level supporting surface, second, third, and fourth legs 18*b*, 18*c*, 18*d* (and their corresponding and respective second, third, and fourth heads 14*b*, 14*c*, 14*d*) may support a first leg 18*a* in a substantially vertical orientation. Accordingly, the first leg 18*a* may position the head 14*a* corresponding thereto (i.e., the first head 14*a*) in a post of prominence above the other heads 14*b*, 14*c*, 14*d*. Such an arrangement may be considered a first stationary position of relatively high stability.

A projectile traveling in a first direction 30 toward the first head 14*a* may strike it. The impact may cause a transfer of momentum from the projectile to the first head 14*a* and move the first head 14*a*. Movement of the first head 14*a* may, in turn, cause the target 10 to pivot 32 with respect to a supporting surface. For example, the target 10 may pivot 32 about an axis 34 extending proximate or between the heads 14*c*, 14*d* located behind (as seen from the viewpoint of the user) the first head 14*a*.

If the momentum transferred to the first head 14*a* is sufficient, the target 10 may pivot 32 out of the first stationary position. For example, the target 10 may continue pivoting 32 about the axis 34 until the first head 14*a* contacts the supporting surface. This contact may stop further pivoting 32 of the target 10. Accordingly, the target 10 may rest on the supporting surface with the first, third, and fourth legs 18*a*, 18*c*, 18*d* (and their corresponding and respective first, third, and fourth heads 14*a*, 14*c*, 14*d*) supporting the second leg 18*b* in a substantially vertical orientation. The second leg 18*b* may position the head 14*b* corresponding thereto (i.e., the second head 14*b*) in the post of prominence above the other heads 14*a*, 14*c*, 14*d*. Such an arrangement may be considered a second stationary position of relatively high stability.

During a transition from a first stationary position to a second stationary position, a center of mass of the target 10 may move or travel across the supporting surface. In general, the direction of travel may be away from the user (i.e., in the first direction 30). However, due to various angles of incidence between a projectile and a head 14, the projectile may impart sideways movement in the head 14. Additionally, varying locations of the heads 14 contacting the supporting surface may produce varying orientations of the pivot axis 34. Accordingly, while a target 10 may typically retreat from a user in response to a hit, it may do so in something other than a straight line. Thus, from the view point of the user, the location of the second head 14*b* in the second stationary position may be behind, behind and to the right of, or behind and to the left of the location of the first head 14*a* in the first stationary position.

The nature or characteristics of the body 12, heads 14, and target surfaces 24 may depend upon the nature or characteristics of the projectiles impacting thereon. For example, in selected embodiments, the projectiles impacting a target 10 may be bullets or pellets fired from a firearm or airgun. In such embodiments, the body 12, heads 14, and target surfaces 24 may be configured to withstand, without degradation, multiple impacts from bullets or pellets traveling at significant velocities.

As appreciated, not all firearm-fired projectiles are equal. Some impart significantly greater energy than others. Accordingly, targets 10 in accordance with the present invention may be caliber specific or caliber-range specific. For example, certain targets 10 may be configured for ".22" ammunition (e.g., .22 long rifle, .22 long, or .22 short ammunition), while other targets 10 may be configured for larger, more powerful ammunition such as 9 mm, .40 SMITH & WESSON, .45 ACP, or the like.

Various characteristics of a target 10 may be varied or controlled to tailor the target 20 to a particular caliber or range of calibers. For example, harder and thicker steels may better withstand impacts from more powerful ammunition. Accordingly, the steel used for a target 10 (e.g., heads 14, legs 18, etc.) handling .44 Magnum may be harder, thicker, or both than the steel used for a target 10 handling .22 long rifle.

Additionally, targets 10 designed for more powerful ammunition may be heavier that those designed for less powerful ammunition. When used on a target 10 of too little mass, the momentum transfer from more powerful ammunition may result in too high a velocity of the target 10. Accordingly, the target 10 may roll too much or too far. Conversely, when used on a target 10 of too much mass, the momentum transfer from less powerful ammunition may result in too little velocity in the target 10. Accordingly, the target 10 may roll too little (e.g., not at all). Thus, to handle a specific type of ammunition, a target 10 may be of sufficient, but not excessive, weight and have a hardness and strength sufficient to prevent penetration and dimpling due to projectile impact.

Figure 2:
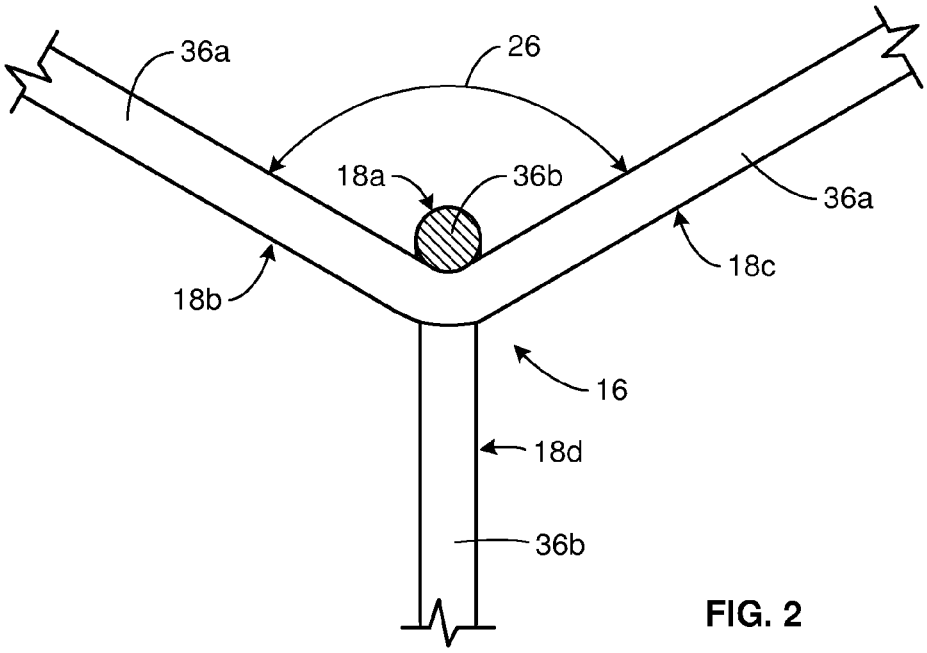
FIG. 2 is a partial, cross-sectional, top plan view of the interior and legs of the target of FIG. 1.

Referring to FIG. 2, legs 18 in accordance with the present invention may have any suitable configuration. In selected embodiments, the legs 18 may be formed of metal rods 36. The rods 36 may be joined together in any suitable manner. For example, in certain embodiments, a target 10 may include two rods 36*a*, 36*b*. A first rod 36*a* may be bend proximate its midpoint to an angle 26 of about 110 degrees. A second rod 36*b* may be similarly bent. The two rods 36*a*, 36*b* may then be joined together (e.g., welded) at their mid points to form four legs 18*a*, 18*b*, 18*c*, 18*d*. Each leg 18 (e.g., leg 18*a*) may be substantially equally angularly spaced from the other three legs 18 (e.g., legs 18*b*, 18*c*, 18*d*).

Legs 18 may have a thickness, length, strength, and hardness suitable for the projectiles to be used thereagainst. In general, legs 18 that are thicker, harder, or both may be used in connection with projectiles that have greater mass, velocity, or both. It has been found that two steel rods 36 each having a diameter of about ⅜ inch and a length of about 16 inches may be bent and joined at their midpoints to provide four legs 18*a*, 18*b*, 18*c*, 18*d* suitable for use in connection with .22 ammunition (i.e., .22 long rifle, .22 long, .22 short, and other ballistically comparable ammunition).

Figure 3:
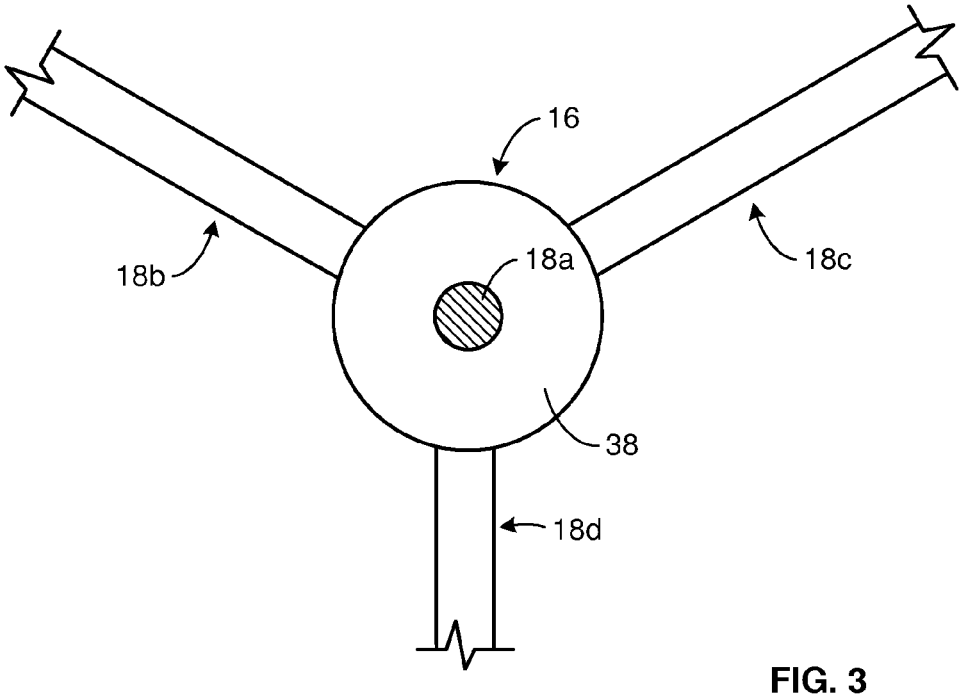
FIG. 3 is a partial, cross-sectional, top plan view of an alternative embodiment of the interior and legs of a target in accordance with the present invention.

Referring to FIG. 3, in selected embodiments, an interior 16 of a target 10 in accordance with the present invention may comprise a central mass 38. Legs 18 may engage such an interior 16 in any suitable manner. For example, in certain embodiments, the interior ends 20 of the legs 18 may thread into apertures formed within the central mass 38. Accordingly, an interior 16 formed as a central mass 38 may support certain modularity (e.g., swapping out legs 18 for caliber-customization purposes or for replacement of damaged legs 18 or heads 14).

Additionally, the size, mass, or make-up, of an interior 16 formed as a central mass 38 may be controlled or selected to provided a desired momentum transfer with a particular projectile or range of projectiles. For example, a larger, more massive central mass 38 may enable selected targets 10 in accordance with the present invention to be used in connection with faster, more massive projectiles. Additionally, in certain embodiments, a central mass 38 may comprise a container housing a fluid or collection of particles that absorb or dissipate a portion of the energy imparted by a projectile impacting the target 10.

Figure 4:
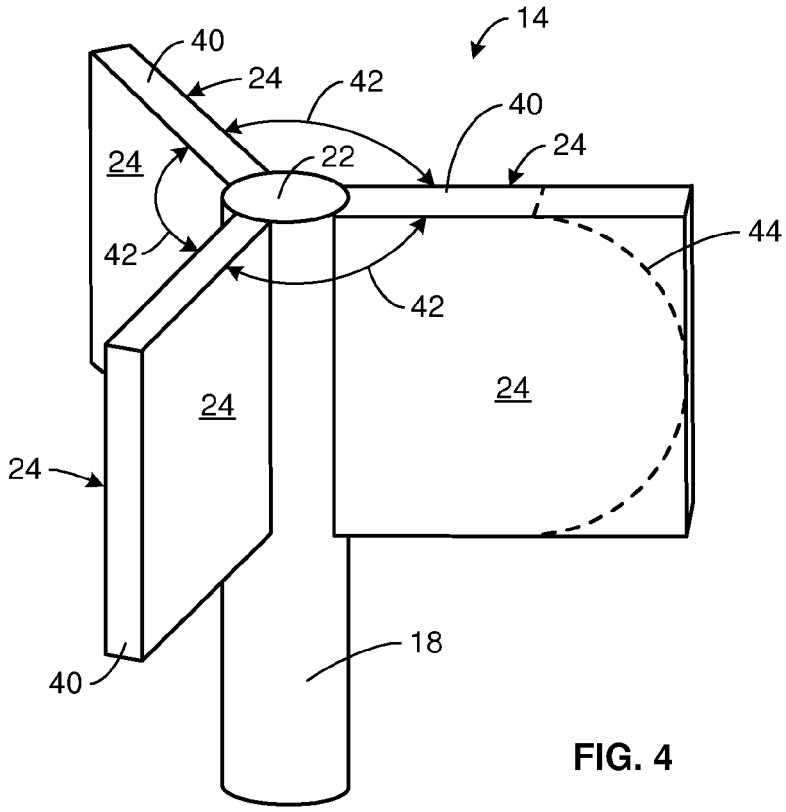
FIG. 4 is a perspective view of one embodiment of a head secured to an exterior end of a leg in accordance with the present invention.

Referring to FIG. 4, in selected embodiments, a head 14 may comprise one or more fins 40 or flanges 40 extending away (e.g., radially away) from an exterior end 22 of a leg 18. Fins 40 may be secured to a leg 18 in any suitable manner. For example, in some embodiments, fins 40 may be welded to the exterior end 22 of a leg 18.

In certain embodiments, a head 14 may comprise three fins 40. Each of the three fins 40 may be separated from adjacent fins 40 by an angle 42 of about 120 degrees. When supported on a substantially vertical leg 18, such a head 14 may present a reasonably sized profile when viewed from anywhere thereabout. Accordingly, a user need not position a target 10 at any particular orientation prior to firing thereon.

A fin 40 in accordance with the present invention may have any suitable profile. In certain embodiments, a fin 40 may have a generally square or rectangular profile. In other embodiments, a fin 40 may have a profile facilitating rolling of the target 10 on a supporting surface. For example, a fin 40 (e.g., every fin 40 on a target 10) may be rounded to provide a desired curvature 44 facilitating pivoting 32 of the target 10 on a supporting surface.

A fin 40 may have any suitable make-up or dimensions. As with other components of a target 10, fins 40 that are thicker, harder, or both may be used in connection with projectiles that have greater mass, velocity, or both. It has been found that fins 40 having a thickness of about 3/16 inch, height of about 1 and ½ inches, and width of about 1 and ½ inches are suitable for use in connection with .22 ammunition.

Figure 5:
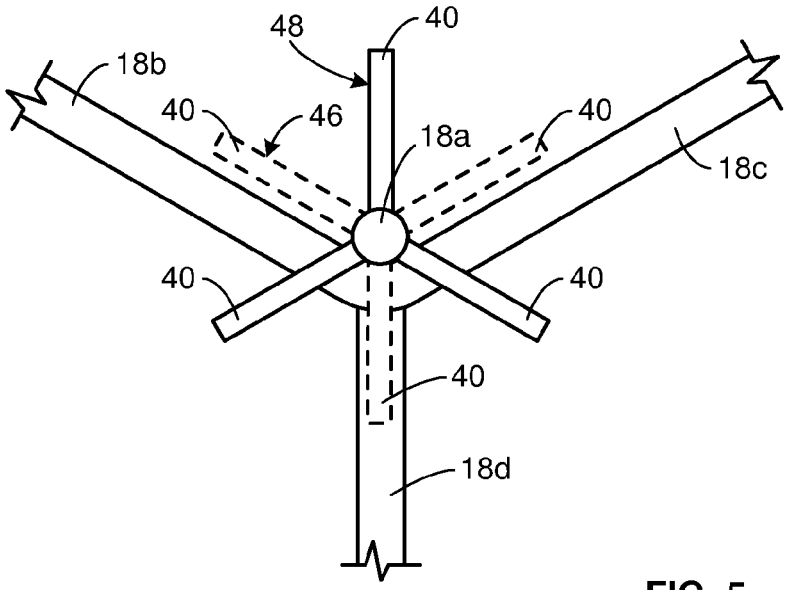
FIG. 5 is a partial, top plan view of the interior, legs, and head of a target in accordance with the present invention showing various configurations for the fins of the head.

Referring to FIG. 5, fins 40 may have any suitable orientation with respect to the legs 18 of a target 10. For example, in certain three-finned embodiments 46 (depicted in dashed lines), the fins 40, when viewed from above, may be substantially aligned with the underlying legs 18 (e.g., legs 18*b*, 18*c*, 18*d*). In such embodiments, when a head 14 is in contact with a supporting surface, two fins 40 may form or define that contact. This may increase the stability of the target 10.

In other three-finned embodiments 48 (depicted in solid lines), the fins 40, when viewed from above, may be secured 60 degrees out of alignment with the underlying legs 18. In such embodiments, when a head 14 is in contact with a supporting surface, one fin 40 may form or define that contact. This may decrease the stability of the target 10 (e.g., make the target 10 easier to roll on a supporting surface). It has been found that three fins 40 positioned 60 degrees out of alignment with the underlying legs 18 are suitable for use in connection with .22 ammunition.

Figure 6:
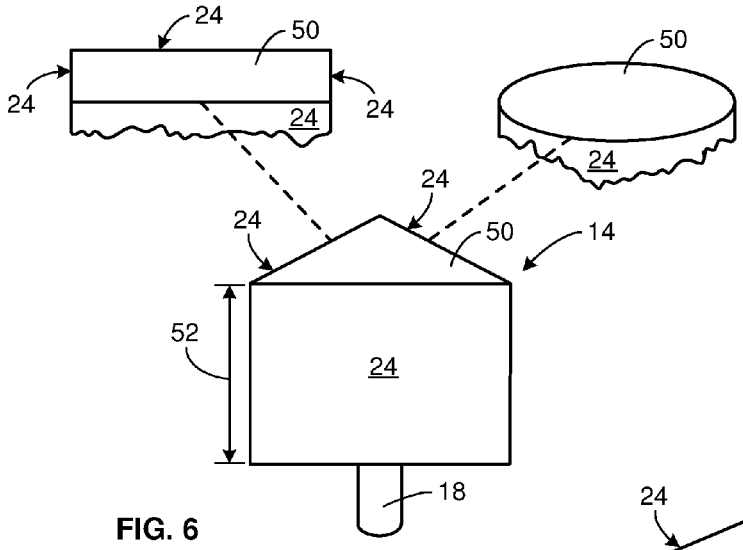
FIG. 6 is a perspective view of an alternative embodiment of a head in accordance with the present invention secured to a leg and providing no concave target surfaces.

Referring to FIG. 6, in selected embodiments, the heads 14 of a target 10 in accordance with the present invention may provide target surfaces 24 that are exclusively flat or convex. Such target surfaces 24 may reduce the risk of any projectile or projectile fragment traveling toward a user after impact. Accordingly, heads 14 having exclusively flat or convex target surfaces 24 may be better suited for use with higher power ammunition.

A head 14 providing target surfaces 24 that are exclusively flat or convex may have a core shape 50. A head 14 may maintain the core shape 50 throughout the height 52 of the head 14. Suitable core shapes 50 may include circles, squares, equilateral triangles, and other non-convex polygons.

A head 14 may define a core shape 50 in any suitable manner. For example, a head 14 may comprise a solid piece of seamless material having a perimeter formed to reflect the core shape 50. Alternatively a head 14 may comprise multiple pieces (e.g., pieces of flat stock) connected together (e.g., welded) to form a perimeter reflecting the core shape 50.

A head 14 may connect to a leg 18 in any suitable manner. In selected embodiments, a head 14 may include an aperture sized to receive the exterior end 22 of a leg 18 therein. In certain embodiments, the aperture in the head 14 and the exterior end 22 may be threaded to support mutual engagement. Accordingly, a head 14 may be selectively removed from a leg 18. Alternatively, a head 14 may be permanently secured to a leg 18. For example, a head 14 may be welded to a leg 18 or formed monolithically therewith (e.g., turned with the leg 18 from a single piece of stock material).

Figure 7:
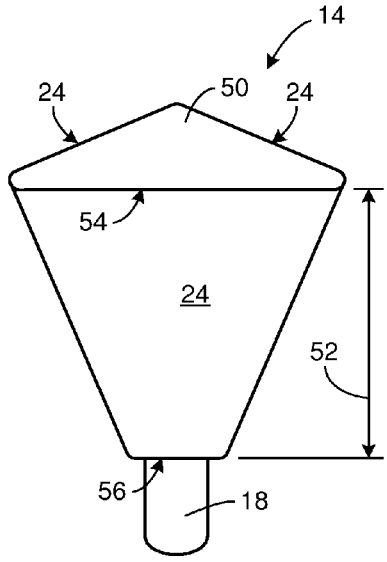
FIG. 7 is a perspective view of another alternative embodiment of a head in accordance with the present invention secured to a leg and providing a taper to preferentially directing projectiles and projectile fragments toward the ground.
Figure 8:
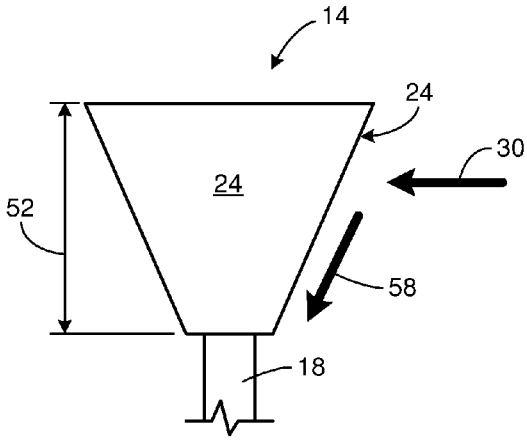
FIG. 8 is a side elevation view of the head of FIG. 7.

Referring to FIGS. 7 and 8, in selected embodiments, the heads 14 of a target 10 in accordance with the present invention may taper. That is, the heads 14 may have a top profile 54 reflecting a core shape 50 and a bottom profile 56 reflecting the same core shape 50. However, the bottom profile 56 may be a scaled down version of the top profile 54. Accordingly, through its height 52, a head 14 may taper from the larger, top profile 54 to the smaller, bottom profile 56.

A taper in accordance with the present invention may tend to direct projectiles impacting thereagainst toward 58 the ground. That is, a projectile may approach a target surface 24 from a first direction 30. Due at least in part to the taper, a corresponding target surface 24 may be oriented obliquely with respect to the first direction 30. Accordingly, the target surface 24 may, after impact, preferentially direct the projectile or projectile fragments. Moreover, with the taper "opening" the target surface 24 toward the ground, the target surface 24 may preferentially direct the projectile or projectile fragments toward 58 the ground. Using such directing, a head 14 in accordance with the present invention may safety handle impacts from more power ammunition.

Figure 9:
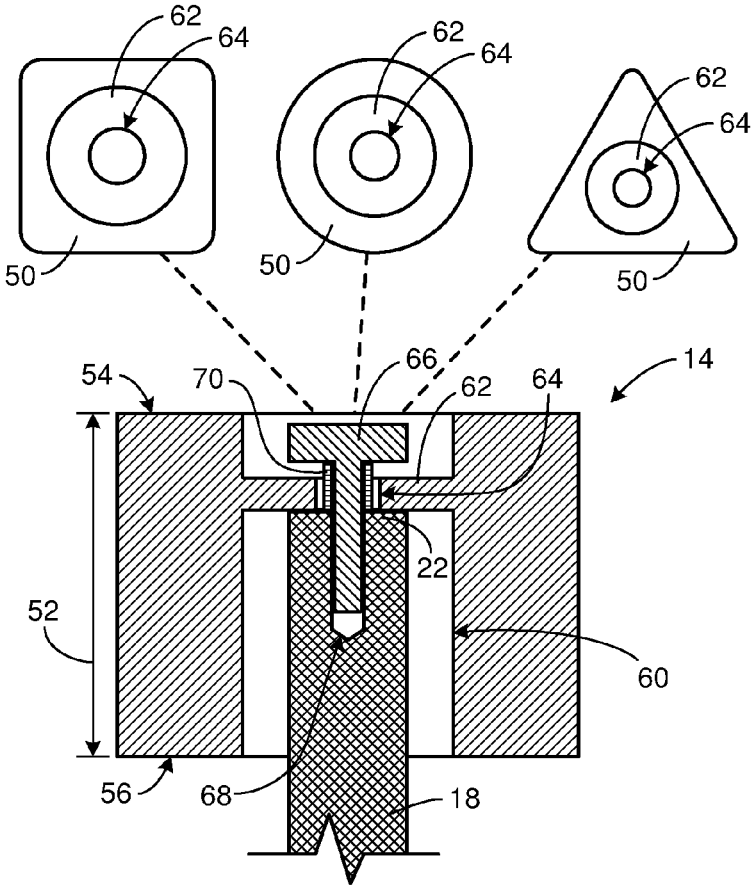
FIG. 9 is a side, cross-sectional view of an embodiment of a head in accordance with the present invention supporting movement with respect to the exterior end of a corresponding leg.
Figure 10:
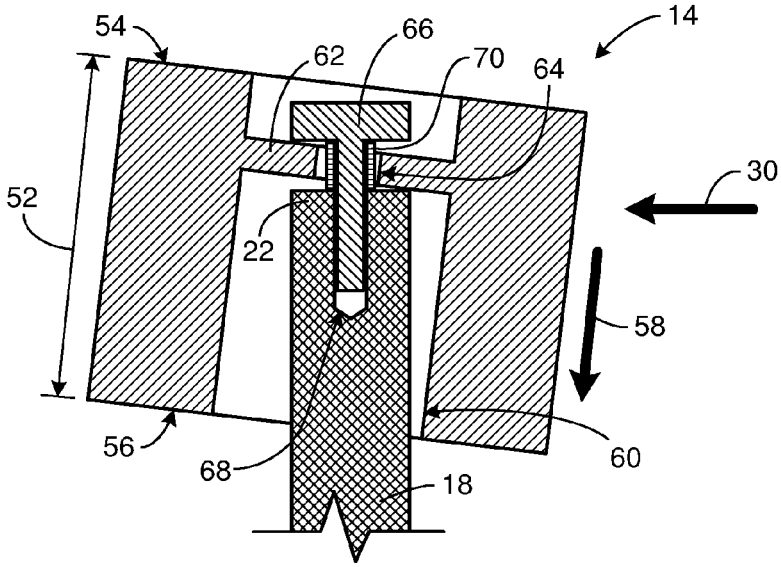
FIG. 10 is a side, cross-sectional view of the head of FIG. 9 with the head pivoted with respect to the leg in response to an impact of a projectile on the head.

Referring to FIGS. 9 and 10, in selected embodiments, a head 14 may be configured to move (e.g., pivot) with respect to a leg 18 in response to a projectile impacting the head 14. This movement may improve the ability of a target 10 to handle impacts from more power ammunition. For example, the movement may tend to absorb or dissipate some of the energy of the impact. Additionally, the movement may pivot a target surface 24 to a position where it is more "open" to the ground. Accordingly, the movement may preferentially direct projectiles and projectile fragments toward 58 the ground.

A head 14 that is moveable in accordance with the present invention may have any suitable core shape 50. Suitable core shapes 50 may include circles, squares, equilateral triangles, and other non-convex polygons. A head 14 that is moveable may maintain the size of the core shape 50 throughout the height 52 of the head 14. Alternatively, a head 14 that is moveable may have a top profile 54 reflecting a core shape 50 and a smaller, bottom profile 56 reflecting the same core shape 50. Accordingly, through its height 52, a head 14 that is moveable may taper from the larger, top profile 54 to the smaller, bottom profile 56.

Movement between a head 14 and a leg 18 may be provided by any suitable mechanism. In selected embodiments, a head 14 may have a first oversized aperture 60 for receiving the exterior end 22 of a leg 18 therewithin. A shoulder 62 may define the limit to which a leg 18 may extend within the first oversized aperture 60. The shoulder 62 may include a second oversized aperture 64 to receive a fastener 66 (e.g., bolt) therethrough. The faster 66 may extend down through the second oversized aperture 64 to engage the exterior end 22 of the leg 18 (e.g., engage a threaded aperture 68 formed in the exterior end 22 of the leg 18). A collar 70 may control the distance between the head of the fastener 66 and the exterior end 22 of the leg 18 (i.e., the amount of slack within which the shoulder 62 may move).

In such an arrangement, the fastener 66 may maintain a head 14 connected to the corresponding leg 18. However, the collar 70 and oversized apertures 60, 64 may preserve for the head 14 a certain range of motion. Accordingly, when impacted by a projectile, a head 14 may move within that range of motion to dissipate energy from the impact, preferentially direct projectiles and projectile fragments toward 58 the ground, or some combination thereof.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A method comprising:

identifying, by a user, a target resting on a supporting surface, the target comprising a body comprising an interior and a plurality of legs extending away from the interior, the plurality of legs comprising a first leg, second leg, third leg, and fourth leg, the second, third, and fourth legs supporting the first leg in a substantially vertical orientation, and a plurality of heads comprising a first head, second head, third head, and fourth head respectively spaced from the interior by the first, second, third, and fourth legs;

identifying, by the user, the first head as occupying a post of most elevated head of the plurality of heads;

impacting, by a projectile projected by the user, the first head;

moving, on the supporting surface in direct response to the impacting, the target away from the user; and hoisting, by the target during the moving, the second head to the post.

2. The method of claim 1, wherein the projectile comprises a bullet fired from a firearm by the user.

3. The method of claim 1, wherein each head of the plurality of heads comprises three flanges substantially equally angularly distributed about the exterior end of a corresponding leg of the plurality of legs.

4. The method of claim 1, wherein the first, second, third, and fourth legs are substantially equally angularly spaced from one another.

5. The method of claim 1, further comprising supporting, by the first, third, and fourth legs after the moving, the second leg in a substantially vertical orientation.

6. The method of claim 1, wherein the interior comprises a center point.

7. The method of claim 6, wherein each leg of the plurality of legs extends radially away form the center point.

8. The method of claim 7, wherein the first, second, third, and fourth legs are substantially equally angularly spaced from one another.

9. The method of claim 8, wherein each leg of the plurality of legs comprises a rod.

10. The method of claim 9, wherein each head of the plurality of heads comprises three flanges substantially equally angularly distributed about an exterior end of a corresponding leg of the plurality of legs.

11. The method of claim 10, wherein each flange of the three flanges extends radially away from the exterior end of the corresponding leg of the plurality of legs.

12. A method comprising:

identifying, by a user, a target resting on a supporting surface, the target defining an interior region and an exterior region surrounding the interior region, the target comprising first, second, third, and fourth legs contained within the interior region, the second, third, and fourth legs supporting the first leg in a substantially vertical orientation, and first, second, third, and fourth heads respectively supported in the exterior region by the first, second, third, and fourth legs;

occupying, by the first head, a post of most elevated head on the target;

impacting, by a projectile projected by the user, the first head;

moving, on the supporting surface in direct response to the impacting, the target away from the user; and hoisting, by the target during the moving, the second head to the post.

13. The method of claim 12, wherein the projectile comprises a bullet fired from a firearm by the user.

14. The method of claim 12, wherein the interior region comprises a center point.

15. The method of claim 14, wherein each leg of the plurality of legs extends radially away form the center point.

16. The method of claim 12, wherein the first, second, third, and fourth legs are substantially equally angularly spaced from one another.

17. The method of claim 12, wherein each leg of the plurality of legs comprises a rod.

18. The method of claim 12, wherein each head of the plurality of heads comprises three flanges substantially equally angularly distributed about an exterior end of a corresponding leg of the plurality of legs.

19. The method of claim 18, wherein each flange of the three flanges extends radially away from the exterior end of the corresponding leg of the plurality of legs.

20. A method comprising:

identifying, by a user, a target resting on a supporting surface, the target comprising first, second, third, and fourth legs, and first, second, third, and fourth heads supported on respective distal ends of the first, second, third, and fourth legs;

supporting, by the second, third, and fourth legs, the first leg in an orientation substantially normal to the supporting surface;

occupying, by the first head during the supporting, a post of most elevated head on the target;

projecting, by the user during the occupying, a projectile at the first head;

impacting, by a projectile, the first head;

moving, on the supporting surface in direct response to the impacting, the target away from the user; and hoisting, by the target during the moving, the second head to the post.

* * * * *